United States Patent [19]

Boyer

[11] 4,129,107

[45] Dec. 12, 1978

[54] MAGNETIC PICKUP TYPE IGNITION DISTRIBUTOR

[75] Inventor: James A. Boyer, Anderson, Ind.

[73] Assignee: General Motors Corporation, Detroit, Mich.

[21] Appl. No.: 826,373

[22] Filed: Aug. 22, 1977

[51] Int. Cl.[2] ..... F02P 7/00

[52] U.S. Cl. ..... 123/146.5 A; 123/148 E; 200/19 M; 310/70 R

[58] Field of Search ..... 123/146.5 A, 148 E; 310/70 R, 70 A; 200/19 R, 19 M

[56] References Cited

U.S. PATENT DOCUMENTS

| | | | |
|---|---|---|---|
| 3,447,004 | 5/1969 | Falge | 123/148 E |
| 3,888,225 | 6/1975 | Boyer et al. | 123/146.5 A |
| 3,955,550 | 5/1976 | Carlsson | 310/70 R |
| 4,057,045 | 11/1977 | Stellwagen | 123/146.5 A |

FOREIGN PATENT DOCUMENTS

| | | | |
|---|---|---|---|
| 962770 | 7/1964 | United Kingdom | 123/146.5 A |

*Primary Examiner*—Charles J. Myhre
*Assistant Examiner*—Andrew M. Dolinar
*Attorney, Agent, or Firm*—Richard G. Stahr

[57] ABSTRACT

In an ignition distributor of the type having an ignition coil mounted in the distributor cap and a magnetic signal generating assembly including a pickup coil, a pickup coil magnetic decoupling arrangement comprising an annular ring member of an electrically conductive material located in a position at which it is magnetically linked by those lines of magnetic flux produced by the ignition coil which also magnetically link the pickup coil.

5 Claims, 11 Drawing Figures

MAGNETIC PICKUP TYPE IGNITION DISTRIBUTOR

This invention relates to internal combustion engine ignition distributors of the magnetic pickup type and, more specifically, to ignition distributors of this type including a pickup coil magnetic decoupling arrangement.

Magnetic pickup type ignition distributors include a magnetic signal generating assembly comprised of a permanent magnet, a stationary pole piece of a magnetic material, a magnetically coupled pickup coil and a rotor member adapted to be driven by the crankshaft of an associated internal combustion engine to vary the intensity of the magnetic field produced by the permanent magnet as the rotor member is rotated. When the rotor member is rotated by the engine, therefore, an alternating current wave form related to crankshaft position is induced in the magnetically coupled pickup coil. The positive to negative polarity translations or the negative to positive polarity translations of the alternating current wave form induced in the pickup coil or both of these polarity translations may be employed by external electronic ignition spark timing circuitry as a crankshaft position reference or references.

With digital electronic ignition spark timing systems, spurious signals induced in the pickup coil as a result of stray magnetic fields such as those produced by the distributor cap mounted ignition coil or other electrical current flow sources may result in false polarity translations of the desired alternating current wave form. As the external utilization circuitry is sensitive to all selected polarity translations, any spurious polarity translations of the wave form induced in the ignition coil to which the external circuitry is sensitive results in false crankshaft position references, an intolerable condition which results in improper ignition spark timing.

A magnetic pickup type ignition distributor including a pickup coil magnetic decoupling arrangement which inhibits the inducement of voltages in the pickup coil by stray magnetic field flux or which reduces the magnitude of these spurious signals to an acceptable level is desirable.

It is, therefore, an object of this invention to provide an improved magnetic pickup type ignition distributor.

It is another object of this invention to provide an improved magnetic pickup type ignition distributor which includes a pickup coil magnetic decoupling arrangement.

In accordance with this invention, an ignition distributor of the type having a magnetic signal generating assembly is provided wherein the magnetic signal generating assembly pickup coil is magnetically decoupled from stray magnetic fields by an annular ring of an electrically conductive material located at a position at which it is magnetically linked by those stray magnetic field flux lines which also link the pickup coil.

For a better understanding of the present invention, together with additional objects, advantages and features thereof, reference is made to the following description and accompanying drawings in which.

One example of a magnetic pickup type ignition distributor with which the pickup coil magnetic decoupling arrangement of this invention may be employed is disclosed and described in U.S. Pat. No. 3,888,225, Boyer et al, which issued June 10, 1975 and is assigned to the same assignee as this invention. However, the ignition distributor will be briefly described herein with regard to the elements thereof which are involved in this invention.

Figure 1:
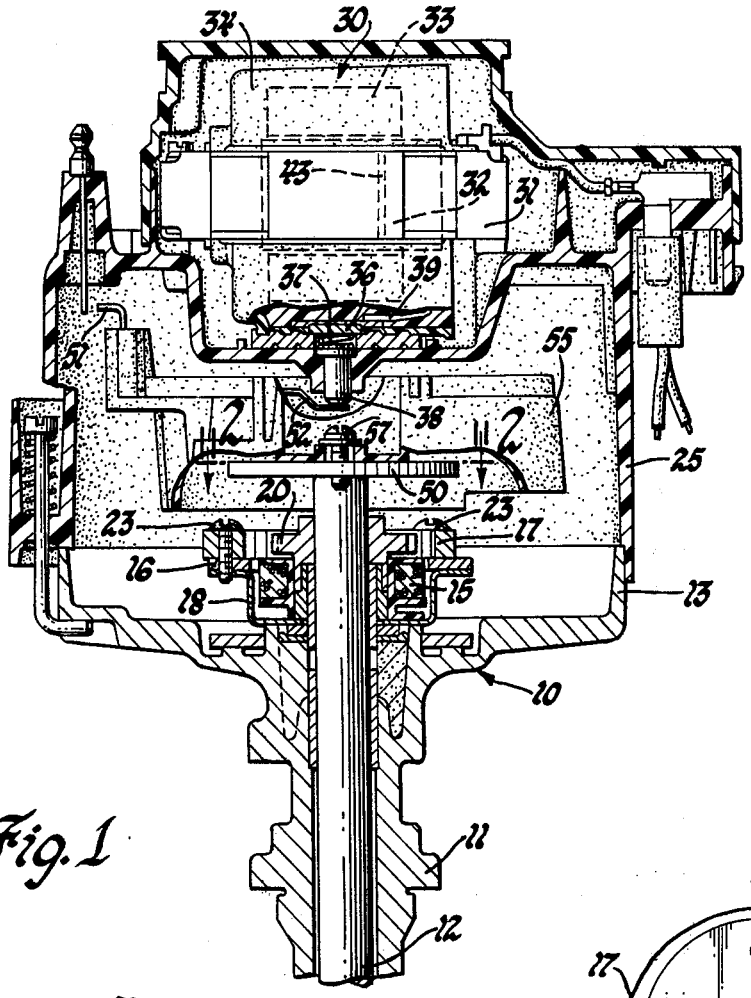
FIG. 1 is a vertical section view of an internal combustion engine magnetic pickup type ignition distributor including one embodiment of this invention.
Figure 3:
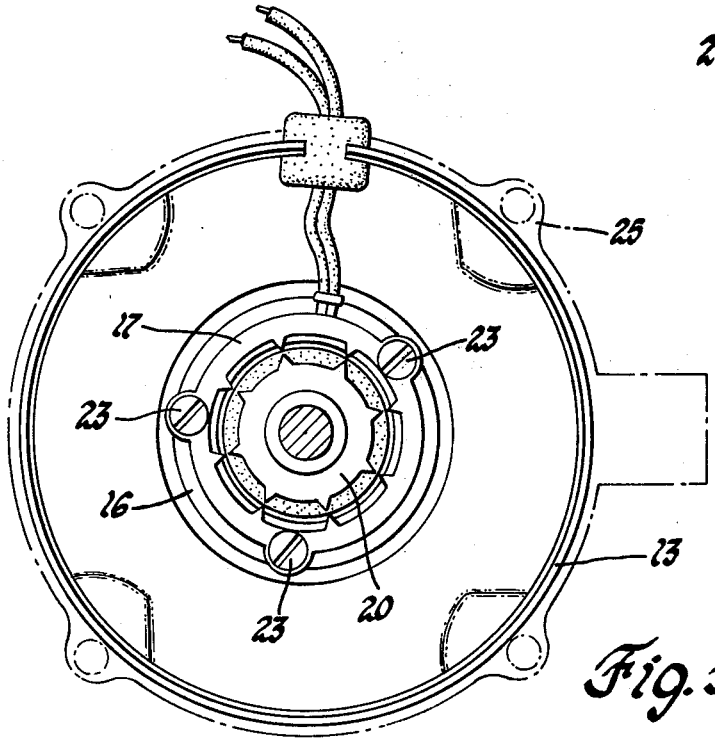
FIG. 3 is a top plan view of the ignition distributor of FIG. 1 with the cap and shaft assembly removed.

Referring to FIG. 1 of the drawing, the reference numeral 10 designates the base portion of an internal combustion engine magnetic pickup type ignition distributor. The lower section 11 of base portion 10 is provided with a bore which receives distributor shaft 12 and the top section of base portion 10 is a cylindrical distributor bowl 13. Contained within cylindrical distributor bowl 13 is a magnetic signal generating assembly which includes an annular pickup coil 15 having the windings thereof concentric with distributor shaft 12, an annular flat permanent magnet 16 having one flat end face thereof of one magnetic polarity and the other flat end face of the other magnetic polarity, a stationary pole piece 17 of a magnetic material and a rotor member 20 arranged to be rotated by distributor shaft 12 in timed relationship with an associated internal combustion engine, not shown. The annular pickup coil 15, annular permanent magnet 16 and stationary pole piece 17 elements of the magnetic signal generating assembly are supported by an annular cup-shaped member 18 of a magnetic material. These three parts are held together by screws 23, as best seen in FIG. 3, which pass through the stationary pole piece 17 and permanent magnet 16 and are threaded into a flange portion of member 18.

Figure 5:
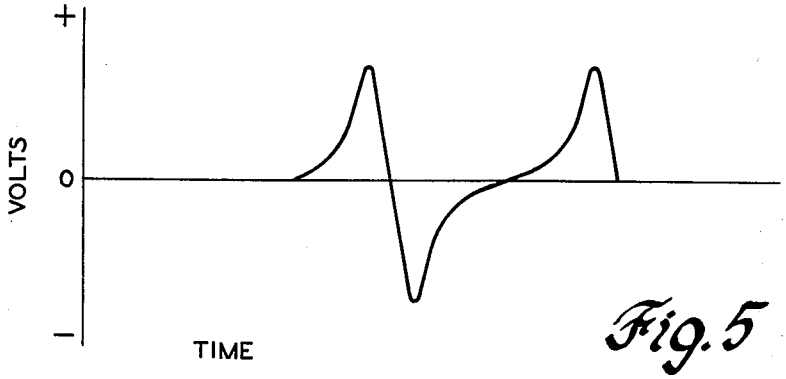
FIG. 5 illustrates the alternating current wave form signal induced in the pickup coil of the magnetic signal generating assembly of the ignition distributor of FIG. 1.

The rotor member 20 is rotated in timed relationship with the engine by the engine in a manner well known in the automotive art within the bore of stationary pole piece 17. Equally spaced about the outer periphery of rotor member 20 and about the bore of stationary pole piece 17 are a series of projections equal in number to the number of cylinders of the engine with which the distributor is being used, as best shown in FIG. 3. In an ignition distributor to be used with an 8-cylinder engine, for example, there are eight equally spaced projections about the outer periphery of rotor member 20 and about the bore of stationary pole piece 17. As each projection on rotor member 20 approaches a projection on stationary pole piece 17, the reluctance of the magnetic circuit between rotor member 20 and stationary pole piece 17 decreases and as each projection on rotor member 20 moves away from a projection on stationary pole piece 17, the reluctance of the magnetic circuit between rotor member 20 and stationary pole piece 17 increases. Consequently, as rotor member 20 is rotated in timed relationship with the engine, the intensity of the magnetic field produced by permanent magnet 16 is varied, increasing and decreasing as each projection on rotor member 20 approaches and passes a projection on stationary pole piece 17. As a result of the permanent magnet 16 magnetic field intensity being varied, an alternating current wave form, as shown in FIG. 5, related to engine crankshaft position is induced in pickup coil 15, which is magnetically coupled to crankshaft position.

Mounted in the distributor cap 25 is an ignition coil generally designated by reference numeral 30. Ignition coil 30 has a laminated magnetic core 31, a primary winding 32, a secondary winding 33 and an outer case 34 formed of an insulating material. Outer case 34 has an opening exposing an annular metal disk or insert member 36 of an electrically conductive material which is electrically connected through an electrically conductive spring 37 to the top end of conductor 38. Ignition coil 30 is illustrated in further detail in FIGS. 7, 8 and 9. As is best seen in FIG. 9, the magnetic core 31 formed of two lamination assemblies designated as 31A and 31B, each of which may be made up of a respective stack of E-shaped laminations of a magnetic material. The two lamination assemblies are positioned within an embracing three-sided bracket member of a U-shaped cross-section which is designated by the reference numeral 40 in FIG. 7. Bracket member 40 has two crimped-over sections 40A and 40B which engage the end portions of lamination assembly 31B to contain the two lamination assemblies 31A and 31B in tight fit. When the lamination assemblies 31A and 31B are assembled in bracket member 40, the two outer leg portions thereof are in engagement with each other over the areas designated by reference numerals 41 and 42. The center legs of the two lamination assemblies, however, are spaced from each other to form an air gap 43 having a dimension of approximately 0.030 inches. Upon assembly in bracket member 40, magnetic core member 31 has three legs 44, 45 and 46, the outer legs 44 and 46 forming a continuous magnetic circuit and the center leg 45 having the air gap 43.

Figure 8:
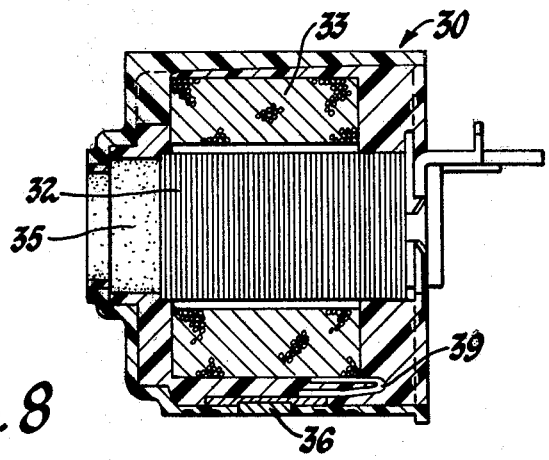
FIG. 8 is a vertical section view of the primary and secondary winding assembly of the ignition coil of FIG. 7.
Figure 9:
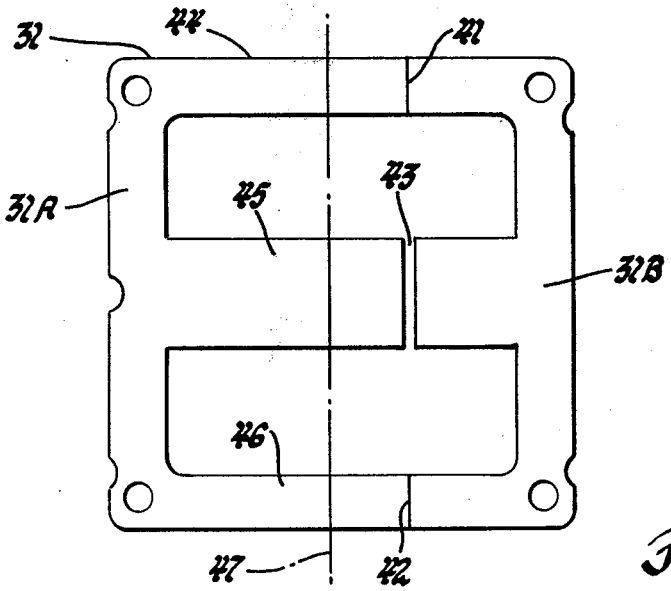
FIG. 9 is a top plan view of the magnetic core of the ignition coil of FIG. 7.

The ignition coil 30 primary-secondary winding assembly which is assembled to center leg 45 of magnetic core 31 is best illustrated in FIG. 8 and comprises a spool 35 of an insulating material, primary winding 32 and secondary winding 33 wound upon spool 35 which is formed with a central opening suitable to be accommodated by center leg 45 of magnetic core 31. One end of secondary winding 33 is electrically connected with the conductive annular metal disk or insert member 36 through conductor 39, the opposite end thereof being grounded. With reference to FIG. 1, when the ignition coil 30 is mounted in the ignition distributor cap 25, therefore, the ungrounded end of secondary winding 33 is electrically connected to the distributor rotor 55 output terminal segment 51 through conductor 39, disk 36, spring 37, conductor 38 and conductor 52.

Figure 7:
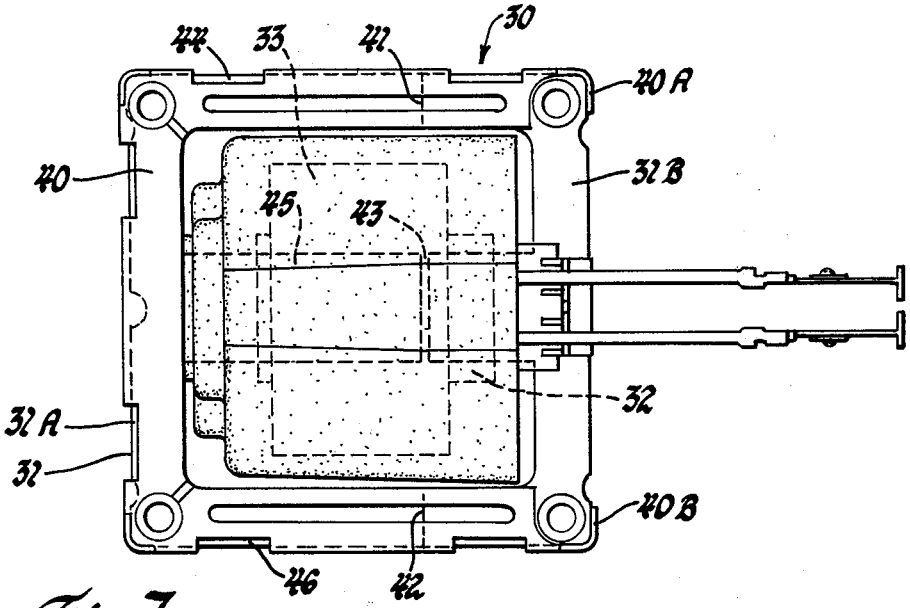
FIG. 7 is a top plan view of an ignition coil utilized with the ignition distributor of FIG. 1.

To fabricate the final ignition coil 30 assembly shown in FIG. 7, the ignition coil primary-secondary winding assembly of FIG. 8 is fitted to lamination assembly 31A by passing the center leg portion thereof through the rectangular center opening of spool 35. Lamination assembly 31B is then assembled such that the center leg portion thereof also passes through the central opening of spool 35. In the final assembly, the lamination assemblies are in engagement over areas 41 and 42 with the air gap 43 in the center leg.

After the ignition coil 30 has been completely fabricated as illustrated in FIG. 7, it is mounted in distributor cap 25 and is so positioned that the longitudinal axis of the primary-secondary winding assembly is normal to the vertical axis of distributor shaft 12 and the center line 47 of magnetic core 31 is normal to and aligned with the vertical axis of distributor shaft 12, all as viewing FIG. 1.

Figure 4:
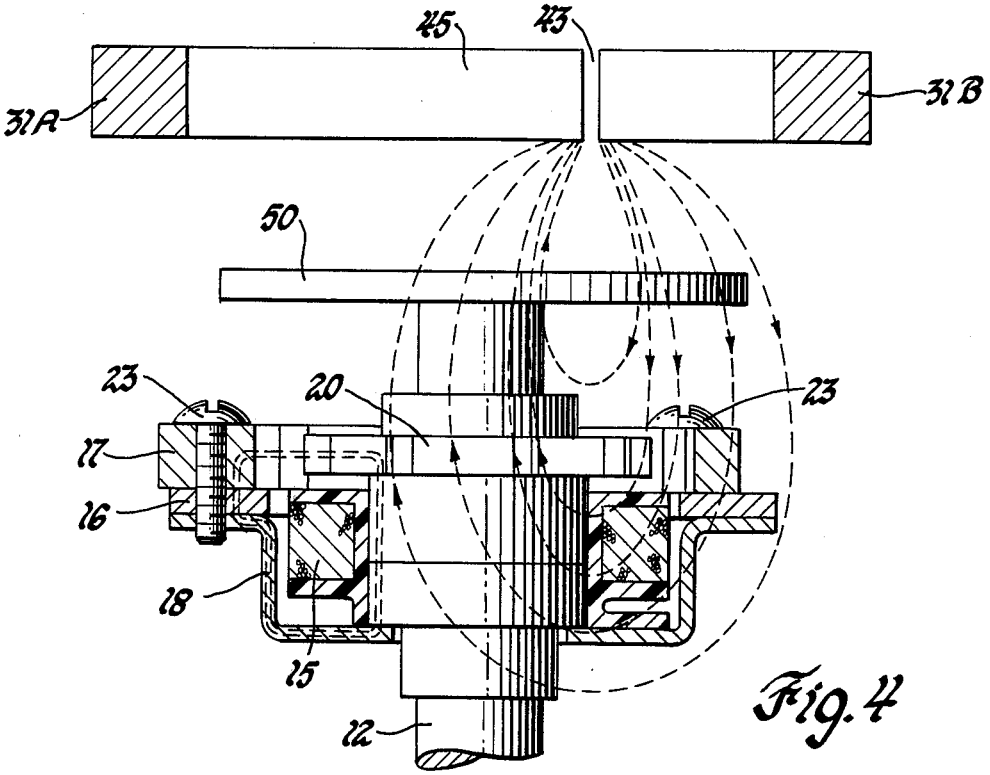
FIG. 4 is a diagrammatic representation of certain parts of the ignition distributor of FIG. 1 illustrating certain flux paths.

In FIG. 4, lines of magnetic flux produced by ignition coil 30 which magnetically link pickup coil 15 are illustrated diagrammatically. It has been learned that the stray magnetic flux field produced by the ignition coil 30 which links pickup coil 15 may induce voltages therein of a sufficient magnitude and polarity to reverse the polarity of the alternating current wave form normally induced in pickup coil 15 by the magnetic signal generating assembly. The voltages induced in pickup coil 15 as a result of the stray magnetic flux field produced by ignition coil 30, therefore, may produce spurious polarity translations of the signal induced in pickup coil 15 to which the external digital electronic ignition spark timing circuitry is sensitive. As these signals appear at unwanted times, an intolerable situation exists in that accurate ignition spark timing is completely destroyed.

To oppose the inducement of voltages in pickup coil 15 by the magnetic flux produced by ignition coil 30 which links pickup coil 15 or to reduce these spurious noise signals to acceptable low levels, a pickup coil 15 magnetic decoupling arrangement is provided. This magnetic decoupling arrangement is an annular ring member 50 of an electrically conductive material located in a position at which it is magnetically linked by those lines of magnetic flux produced by ignition coil 30 which also magnetically link pickup coil 15 for producing a magnetic flux in opposition to that of ignition coil 30. Annular ring member 50 is made up of an electrically conductive material such as aluminum or copper, the higher the conductivity of the material from which this ring is made the better, and, therefore, provides a closed current flow path. It has been found that the diameter of annular ring member 50 should be of the order of the outside diameter of stationary pole piece 17 and may be one-eighth to one-fourth of an inch in thickness depending upon the conductivity of the material used. For example, if annular ring member 50 is made of a high conductivity copper, it may be of the order of one-eighth of an inch thick and if made of aluminum, it may be of the order of one-fourth of an inch thick. As the lower the resistivity of annular ring 50 the better, the cross-section should be great enough to result in low resistance to the flow of circulating currents.

Figure 2:
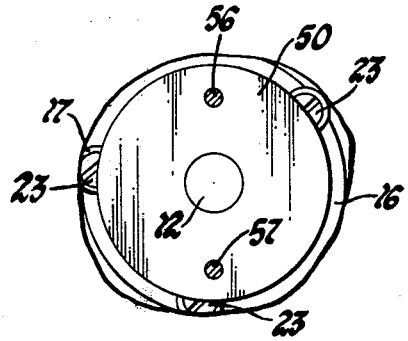
FIG. 2 is a fragmentary top plan view of a portion of the ignition distributor of FIG. 1 taken along line 2—2 and looking in the direction of the arrows.

In the embodiment of FIG. 1, annular ring 50 is mounted upon distributor shaft 12 in coaxial relationship with pickup coil 15 and is arranged to be rotated by distributor shaft 12. Annular ring 50 may be secured to shaft 12 by any suitable arrangement well known in the art. For example, a center bore of annular ring 50 may be press fit on the end of shaft 12. With this embodiment, the distributor rotor member 55 may be mounted upon annular ring 50 by use of screws 56 and 57 which may engage threaded holes in annular ring 50 as best seen in FIG. 2. In the location indicated in FIG. 1, annular ring 50 is in a position in which it is magnetically linked by those lines of magnetic flux produced by ignition coil 30 which also magnetically link pickup coil 15, as is best shown in FIG. 4. These magnetic flux lines produced by ignition coil 30 induce a voltage in annular ring 50 which results in a flow of circulating current through the closed circuit path provided by annular ring 50. As is well known in the art, these circulating currents produce a magnetic flux field which opposes the magnetic flux field which induced the voltage which produces them, consequently, this circulating current flow in annular ring 50 produces a magnetic flux in opposition to that produced by ignition coil 30. Annular ring 50, therefore, is a pickup coil magnetic decoupler which, because of the voltages induced therein by magnetic field flux produced by ignition coil 30 which also links pickup coil 15, produces a magnetic flux field in opposition to that of the ignition coil to oppose the inducement of voltages in pickup coil 15 as a result of ignition coil 30 leakage flux. This opposing magnetic field flux produced by annular ring 50 tends to reduce spurious voltages induced in pickup coil 15 to an acceptable low level which will not interfere with the alternating current output wave form of pickup coil 15.

As is well known in the art, an electrical conductor linked by an expanding or a collapsing magnetic field flux may be thought of as "bending" the flux lines moving relative thereto. If the fingers of the right hand are placed around the conductor to coincide with the direction of the "bend", the thumb points in the direction of potential gradient along the conductor and, hence, the direction of resulting current flow through the conductor. Also, in a current carrying electrical circuit loop, that side of a surface thereof around which an observer sees counterclockwise directed current flow is a north magnetic pole and that side of a surface around which an observer sees clockwise directed current flow is a south magnetic pole.

Figure 10:
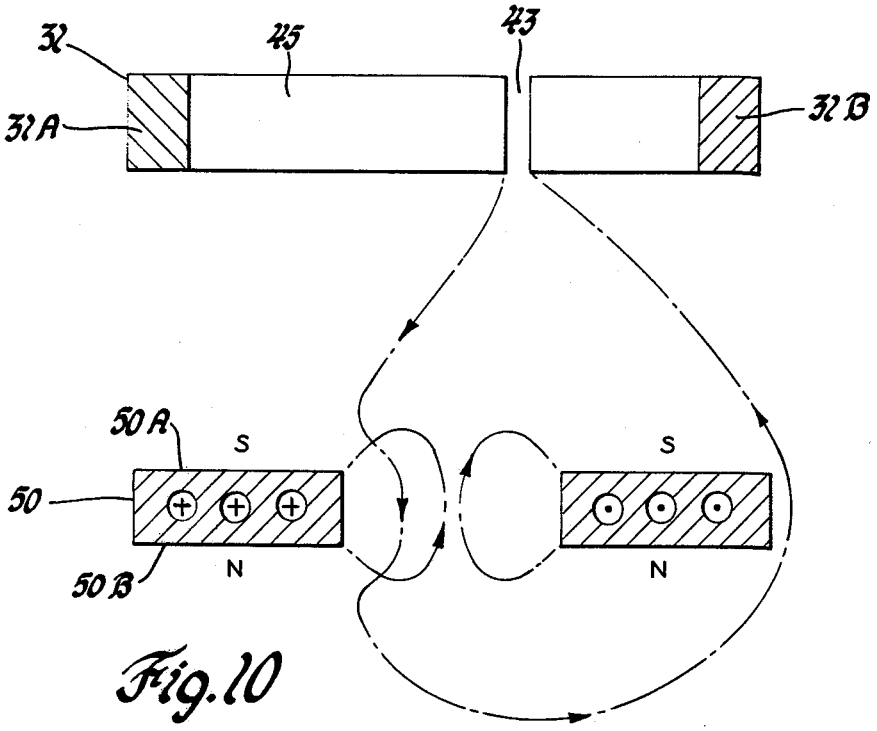
FIGS. 10 and 11 illustrate diagrammatically certain magnetic fields pertinent to this invention.

In FIG. 10, a single line of magnetic flux, of an assumed direction as indicated by the arrows, which is produced upon the rise of ignition coil primary winding 32 energizing current is diagrammatically illustrated with respect to the magnetic core 31 of ignition coil 30 and annular ring 50. As this flux line is one of an expanding magnetic field flux, it may be thought of as moving in a direction from the center toward the outer periphery of annular ring 50. As a result of this relative motion, annular ring 50 may be thought of as "bending" this magnetic flux line to the right as viewing FIG. 10. Applying the hereinabove set forth right hand rule, the circulating current flow through annular ring 50 is in a direction into the page on the left side of annular ring 50 and out of the page on the right side of annular ring 50, as viewing FIG. 10. An observer positioned between annular ring 50 and magnetic core 31, therefore, sees clockwise directed current flow around the top face surface 50A of annular ring 50, hence, top face surface 50A of annular ring 50 is a south magnetic pole and the opposite face surface 50B is a north magnetic pole. The magnetic flux field produced by the circulating current flow through annular ring 50, therefore, is in opposition to that produced by ignition coil 30 as indicated by the arrows in FIG. 10.

Figure 11:
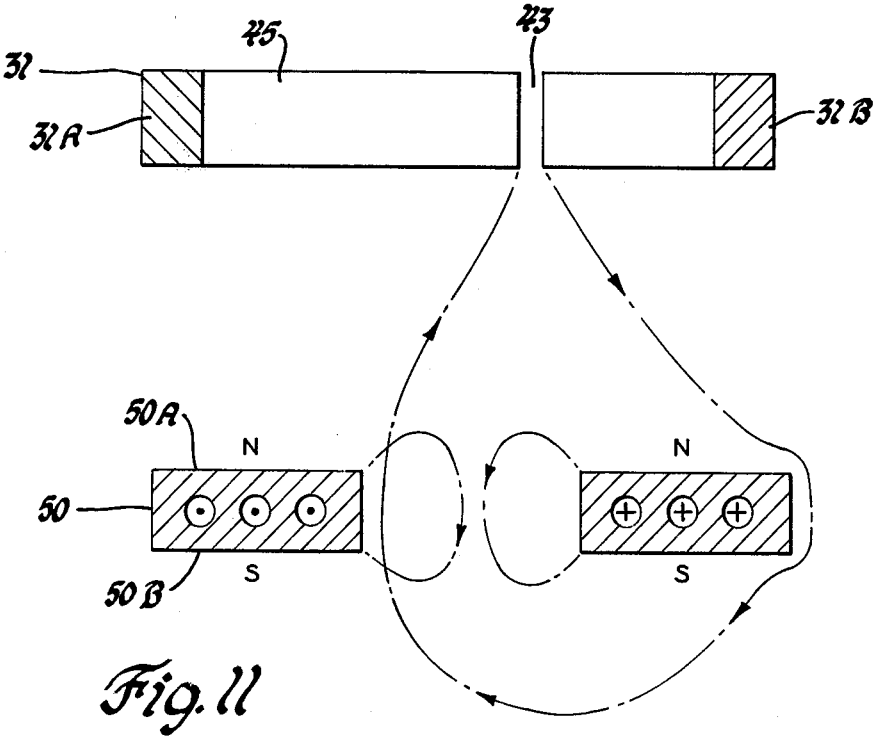

In FIG. 11, a single line of magnetic flux, of an assumed direction as indicated by the arrows, which is produced upon the interruption of ignition coil primary winding 32 energizing current is diagrammatically illustrated with respect to the magnetic core 31 of ignition coil 30 and annular ring 50. As this flux line is one of a collapsing magnetic field flux, it may be thought of as moving in a direction from the outer periphery toward the center of annular ring 50. As a result of this relative motion, annular ring 50 may be thought of as "bending" this magnetic flux line to the right as viewing FIG. 11. Applying the hereinabove set forth right hand rule, the circulating current flow through annular ring 50 is in a direction into the page on the right side of annular ring 50 and out of the page on the left side of annular ring 50, as viewing FIG. 11. An observer positioned between annular ring 50 and magnetic core 31, therefore, sees counterclockwise directed current flow around the top face surface 50A of annular ring 50, hence, top face surface 50A of annular ring 50 is a north magnetic pole and the opposite face surface 50B is a south magnetic pole. The magnetic flux field produced by circulating current flow through annular ring 50, therefore, is in opposition to that produced by ignition coil 30 as indicated by the arrows in FIG. 11.

Figure 6:
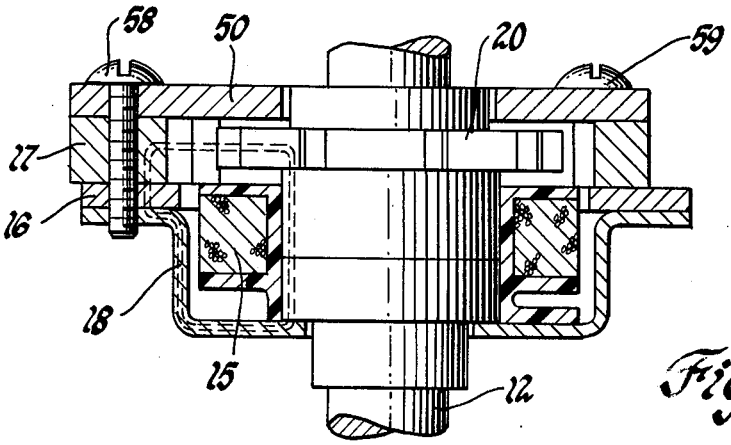
FIG. 6 is a partial vertical section view of another embodiment of this invention.

In FIG. 6 an alternate embodiment of the pickup coil magnetic decoupling arrangement of this invention is set forth. In this embodiment, annular ring 50 is secured by screws 58 and 59 to stationary pole piece 17 is coaxial relationship with pickup coil 15. As with the embodiment of FIG. 1, in this location, annular ring 50 is located in a position at which it is magnetically linked by those lines of magnetic flux produced by ignition coil 30 which also magnetically link pickup coil 15. As with the other embodiment, the circulating current in annular ring 50 produced as a result of a voltage induced therein by the ignition coil 30 leakage flux produces a magnetic flux in opposition to that of ignition coil 30.

In addition to the leakage flux produced by ignition coil 30, pickup coil 15 may also be linked by other stray magnetic fields such as those produced by the leads connected to other electrical appliances such as automotive type air conditioners, horns or cranking motors. When located as shown in the embodiments of FIGS. 1 and 6, annular ring 50 is located in a position at which it is magnetically linked by those lines of magnetic flux produced by these other stray magnetic fields which also link pickup coil 15. As a consequence, the pickup coil magnetic decoupling arrangement of this invention also opposes the inducement of voltages in pickup coil 15 by stray magnetic field flux produced by electrical appliances other than ignition coil 30.

It may be noted that with annular ring 50 located as shown in FIGS. 1, 4 and 6, it is not substantially magnetically linked by the magnetic flux produced by permanent magnet 16 which traverses the magnetic circuit including permanent magnet 16, cup-shaped member 18, shaft 12, rotor member 20 and stationary pole piece 17.

While a preferred embodiment of the present invention has been shown and described, it will be obvious to those skilled in the art that various modifications and substitutions may be made without departing from the spirit of the invention which is to be limited only within the scope of the appended claims.

What is claimed is:

1. In an internal combustion engine magnetic pickup ignition distributor of the type having an ignition coil located in the distributor cap and a magnetic signal generating assembly including a permanent magnet and a magnetically coupled pickup coil: a magnetic circuit linking said pickup coil for providing a path for magnetic flux developed by said permanent magnet and including rotatable means adapted to be driven by the crankshaft of an associated internal combustion engine which is operative when rotated to vary the intensity of the magnetic flux traversing said magnetic circuit whereby an alternating current wave form related to crankshaft position is induced in said pickup coil when said rotatable means is rotated; and pickup coil magnetic decoupling means for opposing the inducement of voltages in said pickup coil by magnetic flux produced by said ignition coil, said last named means comprising an annular ring member of an electrically conductive material providing a closed current flow path located in a position at which it is magnetically linked by those lines of magnetic flux produced by said ignition coil which also magnetically link said pickup coil for producing a magnetic flux in opposition to that produced by said ignition coil and is not substantially magnetically linked by the magnetic flux produced by said permanent magnet which traverses said magnetic circuit.

2. In an internal combustion engine magnetic pickup ignition distributor of the type having an ignition coil located in the distributor cap and a magnetic signal generating assembly including a permanent magnet, a stationary pole piece of a magnetic material and a magnetically coupled pickup coil: rotatable means adapted to be driven by the crankshaft of an associated internal combustion engine for varying the intensity of the magnetic field produced by said permanent magnet whereby an alternating current wave form related to crankshaft position is induced in said magnetically coupled pickup coil when said rotatable means is rotated; and pickup coil magnetic decoupling means for opposing the inducement of voltages in said pickup coil by magnetic flux produced by said ignition coil, said last named means comprising an annular ring member of an electrically conductive material secured to said pole piece in coaxial relationship with said pickup coil located in a position at which it is magnetically linked by those lines of magnetic flux produced by said ignition coil which also magnetically link said pickup coil for producing a magnetic flux in opposition to that of said ignition coil.

3. In an internal combustion engine magnetic pickup ignition distributor of the type having an ignition coil located in the distributor cap and a magnetic signal generating assembly including a permanent magnet and a magnetically coupled pickup coil: a distributor shaft adapted to be driven by the crankshaft of an associated internal combustion engine; rotatable means adapted to be rotated by said distributor shaft for varying the intensity of the magnetic field produced by said permanent magnet whereby an alternating current wave form related to crankshaft position is induced in said magnetically coupled pickup coil when said rotatable means is rotated; and pickup coil magnetic decoupling means for opposing the inducement of voltages in said pickup coil by magnetic flux produced by said ignition coil, said last named means comprising an annular ring member of an electrically conductive material providing a closed current flow path adapted to be rotated by said distributor shaft in coaxial relationship with said pickup coil and distributor shaft and located in a position at which the interior thereof is magnetically linked by those lines of magnetic flux produced by said ignition coil which also magnetically link the interior of said pickup coil for producing a magnetic flux in opposition to that produced by said ignition coil.

4. In an internal combustion engine magnetic pickup ignition distributor of the type having an ignition coil located in the distributor cap and a magnetic signal generating assembly including a permanent magnet and a magnetically coupled pickup coil: a magnetic circuit linking said pickup coil for providing a path for magnetic flux produced by said permanent magnet and including rotatable means adapted to be driven by the crankshaft of an associated internal combustion engine which is operative when rotated to vary the intensity of the magnetic flux traversing said magnetic circuit whereby an alternating current wave form related to crankshaft position is induced in said pickup coil when said rotatable means is rotated; and pickup coil magnetic decoupling means for opposing the inducement of voltages in said pickup coil by stray magnetic field flux, said last named means comprising an annular ring member of an electrically conductive material providing a closed current flow path located in a position at which it is magnetically linked by those lines of stray magnetic field flux which also magnetically link said pickup coil for producing a magnetic flux in opposition to that produced by said stray magnetic field and is not substantially magnetically linked by the magnetic flux produced by said permanent magnet which traverses said magnetic circuit.

5. A magnetic pickup device for generating a voltage wave form indicative of the position of the crankshaft of an internal combustion engine for controlling the spark timing of the engine comprising: a base member; a metallic shaft rotatably supported by said base member and adapted to be rotated by an associated internal combustion engine; an annular pickup coil supported by said base member and disposed concentrically about said shaft; a rotor member formed of magnetic material secured to said shaft; a permanent magnet supported by said base member; a magnetic circuit linking said pickup coil, said magnetic circuit including said permanent magnet and said rotor member and said rotor member including means for varying the reluctance of said magnetic circuit when said rotor member is rotated with said shaft whereby an alternating voltage wave form indicative of engine crankshaft position is induced in said pickup coil; and a flux shielding plate member of electrically conducting material having a central opening whereby said plate member forms a one-turn electrical conductor, said plate member being located in such a position that the central opening thereof is substantially coaxial with the axis of said shaft and pickup coil that it is operative to develop a magnetic field opposing stray magnetic fields traversing the interior of said pickup coil and said shaft to thereby oppose unwanted voltages from being induced in said pickup coil and that it is axially spaced from said magnetic circuit whereby it is not substantially linked by the magnetic flux produced by said permanent magnet traversing said magnetic circuit.

* * * * *